United States Patent [19]

Yousif

[11] Patent Number: 4,596,338

[45] Date of Patent: Jun. 24, 1986

[54] AIR PERMEABLE CONTAINER CAP LINING AND SEALING MATERIAL

[76] Inventor: Bahjat Yousif, 582 Washington St., Elmhurst, Ill. 60126

[21] Appl. No.: 752,619

[22] Filed: Jul. 8, 1985

[51] Int. Cl.[4] ..... B65D 53/04

[52] U.S. Cl. ..... 215/232; 215/261; 215/347; 428/486

[58] Field of Search ..... 215/232, 261, 347; 428/486, 487

[56] References Cited

U.S. PATENT DOCUMENTS 2,026,937 1/1936 Eisen ..... 215/232

4,503,123 3/1985 Ou Yang ..... 428/486 X

*Primary Examiner*—Donald F. Norton

*Attorney, Agent, or Firm*—Robert F. Van Epps

[57] ABSTRACT

A laminated air permeable container cap lining and sealing material comprising layers of pulp, aluminum foil, paper, wax, paper and air permeable heat sealing material.

4 Claims, 2 Drawing Figures

AIR PERMEABLE CONTAINER CAP LINING AND SEALING MATERIAL

BACKGROUND OF THE INVENTION

1. Field of the Invention

The present invention relates generally to the field of packaging and more particularly to a new and improved air permeable container cap lining material suitable for use with conventional induction heating/cap sealing techniques.

2. Description of the Prior Art

Prior to the present invention, it has been common practice to line container screw-caps with a laminated material consisting of a layer of pulp to which is wax mounted a layer of aluminum foil. A layer of polyester film is fixed by an adhesive to the foil and film of sealing material is fixed by an adhesive to the polyester layer. The laminate is produced in strips which are ultimately die-cut into discs and mounted in the container cap with a hot melt adhesive. The lined caps are torqued on to a bottle or jar filled with a given product and passed through a high frequency induction heating unit. The aluminum foil is heated to a temperature in the range of about 150–300 degrees Farenheit resulting in melting of the laminating wax between the pulp and foil. The sealing material is selected to match the material used in the bottle or jar and is heat welded or sealed to the rim of the bottle. As the user of the product removes the cap, the pulp will lift with the cap leaving the foil and facing structure on the bottle to provide tamper protection and prevent leakage.

Many products, particularly foods and pharmaceutical products, are packed in a warm condition and contract upon cooling to ambient temperatures, such as coffee creamer. Other products, such as marshmallow creame, are volume-sensitive to changes in ambient air pressure. Since the above described prior art seal is air tight, upon contraction of the product due to cooling or pressure change a plastic container tends to collapse inwardly producing an undesirable appearance which adversely affects the marketability of the product. Conversely, upon product expansion the internal pressure within the container can cause the container to break or the seal to rupture.

One attempted solution to this problem has been to use a finely perforated glassine seal which is secured to the mouth of a bottle or jar using a water base adhesive. The application of the water base adhesive to the bottle or jar is much slower and cumbersome than the heat sealing technique and with hygroscopic products such as instant coffee may lead to contamination of the contents.

OBJECTIVES AND SUMMARY OF THE INVENTION

From the preceding discussion, it will be understood that among the various objectives of the present invention are included the following:

- the provision of a new and improved air permeable cap liner material;
- the provision of a material of the above-described character which is compatible with induction heating sealing techniques; and
- the provision of a material of the above-described character which minimizes product contamination.

These and other objectives of the invention are efficiently achieved by providing a coated laminated structure which, when induction heated, delaminates such as to leave the non-air-permeable layers together as a cap liner and an air-permeable seal heat mounted to the rim of the bottle or jar holding the product.

The foregoing as well as additional objects, features and advantages of the present invention will become more apparent from the following detailed description taken in conjunction with the appended drawings.

DESCRIPTION OF THE PREFERRED EMBODIMENT

Figure 1:
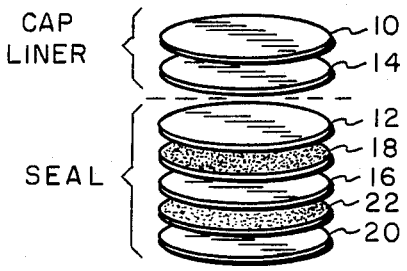
PRIOR ART FIG. 1
FIG. 1 is an exploded view of a foil seal cap liner according to the prior art.

With reference now to FIG. 1, there is illustrated in an exploded view of an induction cap liner of the prior art. Particular dimension of the various layers are included for the purposes of illustration only. The structure comprises a 0.030 inch layer 10 of white linned pulp. A 1.0 mil. layer of aluminum foil 12 is mounted to the pulp layer 10 by a layer of wax 14. A 0.5 mil. supporting film of polyester 16 is secured by a layer of adhesive 18 to the foil 12. A sealing film 20 is secured by adhesive 22 to the polyester film 16. The material for the sealing film 20 is determined by the material of which the bottle or jar is formed; e.g. a polyvinylchloride bottle will require a polyvinylchloride sealing polymer coating, polyethylene is used with polyethylene, etc.

When a capped bottle having a prior art foil seal cap liner is passed through the induction heater, the aluminum foil 12 is heated sufficiently to melt the wax layer 14 which is absorbed into the pulp layer 10. The structure delaminates at the dashed line such that the portion above the line becomes the cap liner and that below becomes the bottle seal as the sealing film 20 is heat welded to the rim.

Figure 2:
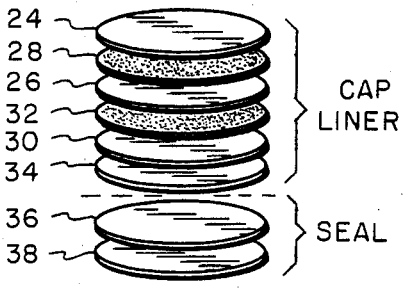
FIG. 2 is an exploded view of an air permeable cap liner in accordance with the principles of the present invention.

The induction seal cap liner of the present invention is illustrated in FIG. 2 and is also of a laminated construction. This structure begins with a layer of pulp 24 to which a layer of aluminum foil 26 is secured by adhesive 28. A first layer of paper 30 such as a 30–60 pound bleached white kraft is secured by adhesive 32 to the foil 26. A layer of wax 34 is used to secure a layer of water and/or oil proofed air-permeable paper 36 to the first layer of paper 30. The air-permeable paper layer 36 is coated with an air-permeable heat sealing layer 38.

The air permeable paper layer 36 may be, for example, a 20–40 pound per reem bleached kraft which has been rendered water resistant by treating with melamine or a urea formaldehyde resin. Oil resistance may be provided with a fluorocarbon treatment. The paper may be cellulosic or a synthetic such as Tyvek which is a trademarked product of Du Pont. Both types of treated paper are well known in the art and are commercially available from a variety of manufacturers including by way of example James River Corp., KVP Group, of Parchment, Mich. 49004. The air permeable heat sealing layer 38 may be a water base acrylic polymer immulsion applied to layer 36 at a rate of from 6–20 pounds per reem of paper. It is preferably applied in multiple coats to eliminate pinholing through the paper layer 36 and thus prevent weeping of the product through the seal. Water based acrylic polymer immulsions useful in the practice of the invention include such polymers as ethylene vinyl chloride, vinyl acetate, ethylene vinyl acetate, polyvinyledene chloride, polyvinyl chloride, and thermoset vinyl. As an alternative to the air permeable paper layer an air permeable plastic film with or without paper support may be used to allow air permeation and equalize the package internal pressure with that of the ambient atmosphere.

When the induction seal cap liner of the present invention is passed through an induction heating system the structure delaminates at the dashed line when the wax melts and is absorbed into the paper layer 30. Again, that portion above the dashed line becomes the cap liner and that below becomes the bottle seal as the heat sealing layer 38 seals to the bottle rim. It will thus be seen that the resulting bottle seal is water/oil resistant and air permeable, yet compatible with the conventional induction heat sealing technique which is preferred over the alternative use of water base adhesives. The mutually exclusive limitations of the prior art are thereby avoided.

From the foregoing description it will be seen that the applicant has provided a new and improved air permeable induction seal cap liner wherein the objectives set forth herein are efficiently achieved. Since certain changes in the above-described construction will occur to those skilled in the art without departure from the scope of the invention, it is intended that all matter set forth in the preceding description or shown in the appended drawings shall be interpreted as illustrative and not in a limiting sense.

Having described what is new and novel and desired to secure by Letters Patent, what is claimed is:

1. A laminated air permeable container cap lining and sealing material comprising a layer of pulp;

a layer of aluminum foil adhesively secured to one surface of said layer of pulp;

a first layer of paper adhesively secured to said layer of aluminum foil opposite said layer of pulp;

a layer of wax disposed on the surface of said first layer of paper opposite said layer of aluminum foil and having a preselected melting point;

a second layer of paper disposed on said layer of wax opposite said first layer of paper, being air permeable, and treated to resist penetration by the contents to be placed in said container; and a layer of air permeable heat sealing material disposed on the surface of said second layer of paper opposite said layer of wax;

such that upon heating of said layer of aluminum foil to a temperature above the melting point of said layer of wax, said layer of wax melts and is absorbed into said first layer of paper and said second layer of paper is sealed to the rim of said container by said air permeable heat sealing material.

2. A material as set forth in claim 1 wherein said second layer of paper is treated for water resistance.

3. A material as set forth in claim 1 wherein said second layer of paper is treated for oil resistance.

4. A material as set forth in claim 1 wherein said air permeable heat sealing material is selected from the group of water based acrylic polymers consisting of ethylene vinyl chloride,
vinyl acetate,
ethylene vinyl acetate,
polyvinyledene chloride, and
thermo set vinyl.

* * * * *